US010484766B2

(12) United States Patent
Huo et al.

(10) Patent No.: US 10,484,766 B2
(45) Date of Patent: Nov. 19, 2019

(54) SPEAKER MODULE

(71) Applicant: GOERTEK INC., Weifang, Shandong (CN)

(72) Inventors: Xinxiang Huo, Weifang (CN); Yun Yang, Weifang (CN); Zhijun Sun, Weifang (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 16/080,843

(22) PCT Filed: May 18, 2016

(86) PCT No.: PCT/CN2016/082430
§ 371 (c)(1),
(2) Date: Aug. 29, 2018

(87) PCT Pub. No.: WO2017/148009
PCT Pub. Date: Sep. 8, 2017

(65) Prior Publication Data

US 2019/0058933 A1 Feb. 21, 2019

(30) Foreign Application Priority Data

Feb. 29, 2016 (CN) ..... 2016 1 0111785

(51) Int. Cl.
*H04R 1/02* (2006.01)
*H04R 1/28* (2006.01)

(52) U.S. Cl.
CPC ..... *H04R 1/021* (2013.01); *H04R 1/026* (2013.01); *H04R 1/2803* (2013.01); *H04R 1/2826* (2013.01)

(58) Field of Classification Search
CPC ..... H04R 1/021; H04R 1/026; H04R 1/2803; H04R 1/2826
(Continued)

(56) References Cited

U.S. PATENT DOCUMENTS 7,556,121 B2 * 7/2009 Yang ..... H04M 1/03 181/145
9,154,865 B2 * 10/2015 Zha ..... H04R 1/021
(Continued)

FOREIGN PATENT DOCUMENTS

CN 204231652 U 3/2015
CN 204906708 U 12/2015
(Continued)

*Primary Examiner* — Oyesola C Ojo
(74) *Attorney, Agent, or Firm* — Saliwanchik, Lloyd & Eisenschenk

(57) ABSTRACT

Disclosed in the present invention is a speaker module. The speaker module comprises a housing, and a speaker unit located within the inner chamber of the housing. The speaker unit separates the inner chamber into a front sound chamber and a rear sound chamber which are isolated from each other. The housing is embedded with a metal sheet, the metal sheet being provided with a pressure relief hole which is acoustically sealed and used for communicating a rear sound chamber and the external environment. The pressure relief hole is provided with a mesh on the side away from the rear sound chamber. The speaker module provided by the present invention has a housing embedded with a metal sheet, the metal sheet being provided with a pressure relief hole. The inner diameter of the pressure relief hole can be made small according to actual needs. The rear sound chamber and the external environment can reach an air pressure balance and have good acoustic seal effect without additional arrangement of pressure relief groove. Furthermore, the pressure relief hole of the speaker module does not need a gland. The structure is simple and the yield rate is high.

9 Claims, 2 Drawing Sheets

(58) Field of Classification Search
USPC ..... 381/349
See application file for complete search history.

(56) References Cited

U.S. PATENT DOCUMENTS

| | | | | |
|---|---|---|---|---|
| 9,414,140 | B2 * | 8/2016 | Wang | H04R 1/021 |
| 2009/0245565 | A1 * | 10/2009 | Mittleman | H04M 1/035 381/365 |
| 2013/0094685 | A1 * | 4/2013 | Seo | H04R 1/021 381/332 |
| 2013/0223655 | A1 * | 8/2013 | Lee | H04M 1/035 381/189 |
| 2014/0177902 | A1 * | 6/2014 | Yeh | H04R 1/227 381/394 |
| 2014/0283691 | A1 * | 9/2014 | Furuuchi | B01D 71/36 96/12 |
| 2014/0301587 | A1 * | 10/2014 | Ji | H04R 1/025 381/332 |
| 2015/0172800 | A1 * | 6/2015 | Azmi | H04R 1/1016 381/380 |
| 2017/0223443 | A1 * | 8/2017 | Silvestri | H04R 1/1016 |

FOREIGN PATENT DOCUMENTS

| | | | |
|---|---|---|---|
| CN | 204948336 | U | 1/2016 |
| CN | 205029864 | U | 2/2016 |
| CN | 105592389 | A | 5/2016 |
| JP | H11164395 | A | 6/1999 |

* cited by examiner

SPEAKER MODULE

CROSS REFERENCE TO RELATED APPLICATIONS

This application is a National Stage of International Application No. PCT/CN2016/082430, filed on May 18, 2016, which claims priority to Chinese Patent Application No. 201610111785.9, filed on Feb. 29, 2016, both of which are hereby incorporated by reference in their entireties.

FIELD OF THE INVENTION

The present invention relates to the field of an acoustic energy conversion technology, and in particular, to a speaker module.

BACKGROUND OF THE INVENTION

In order to ensure that a micro speaker module can work normally in different air pressure environments, a pressure relief device is generally arranged in the rear sound chamber of a speaker to maintain the air pressure equilibrium between the rear sound chamber and the external environment.

The existing pressure relief device is generally designed as follows: a pressure relief hole is provided on a position, where the rear sound chamber is located, of the housing, and, as the material of the housing generally uses plastics, the diameter of the pressure relief hole is usually greater than 0.1 mm due to the material limitation. A large size of the pressure relief hole is not good for the speaker's acoustic seal. Besides, a pressure relief groove with a gland affixed on it must be disposed on the housing on the side close to the rear sound chamber. The pressure relief groove communicates with the pressure relief hole to form a pressure relief passage, which not only can equilibrate the pressure between the rear sound chamber and the external environment, but also can achieve a technical effect of acoustic seal. In this structure, the pressure relief device is composed of a pressure relief hole, a pressure relief groove, a gland, and a mesh. For the pressure relief device, the structure is complicated, the processing is difficult and the yield rate is low.

SUMMARY OF THE INVENTION

An objective of the present invention is to provide a novel technical solution for a speaker module.

According to a first aspect of the invention, there is provided a speaker module, comprising a housing and a speaker unit located within the inner chamber of the housing, the speaker unit separating the inner chamber into a front sound chamber and a rear sound chamber which are isolated from each other, the housing being embedded with a metal sheet, the metal sheet being provided with a pressure relief hole which is acoustically sealed and used for communicating a rear sound chamber and the external environment, and the pressure relief hole being provided with a mesh on the side away from the rear sound chamber.

Preferably, the metal sheet is disposed within the housing on a separator which is used for separating the front sound chamber from the rear sound chamber.

Preferably, the metal sheet is embedded in the housing and forms a positioning groove on the side close to the front sound chamber, the mesh is arranged in the positioning groove, and the end face of the mesh which is away from the metal sheet is flush with the surface of the housing.

Preferably, the housing comprises an upper housing, a middle housing, and a lower housing which are fastened together, and the separator is disposed on the middle housing.

Preferably, the material of the metal sheet is stainless steel, copper alloy or aluminum alloy.

Preferably, the cross section of the pressure relief hole is polygonal or circular.

Preferably, the pressure relief hole is circular, and the inner diameter of the pressure relief hole is 0.1 mm or less.

Preferably, the housing is embedded with a metal sheet.

Preferably, the metal sheet is provided with one or more pressure relief holes.

Preferably, the mesh is a waterproof and air-permeable mesh.

The inventors of the present invention find that in the prior art a pressure relief device is composed of a pressure relief hole, a pressure relief groove, a gland and a mesh, and for the pressure relief device, the structure is complicated, the processing is difficult and the yield rate is low. Also, due to material limitation, the pressure relief hole cannot be made small in size, which is not good for acoustic seal. Therefore, the technical task to be implemented or the technical problem to be solved by the present invention is not anticipated by those skilled in the art, and thus the present invention is a novel technical solution.

The speaker module provided by the present invention has a housing embedded with a metal sheet, the metal sheet being provided with a pressure relief hole. The inner diameter of the pressure relief hole can be made small according to actual needs. The rear sound chamber and the external environment can reach an air pressure balance and have good acoustic seal effect without additional arrangement of pressure relief groove.

Furthermore, the pressure relief hole of the speaker module does not need a gland. The structure is simple and the yield rate is high.

Other features and advantages of the present invention will become apparent from the following detailed description of exemplary embodiments of the present invention with reference to the accompanying drawings.

BRIEF DESCRIPTION OF THE DRAWINGS

The accompanying drawings, which are incorporated in and constitute a part of the description, illustrate embodiments of the present invention and, together with the description thereof, serve to explain the principles of the present invention.

DETAILED DESCRIPTION

Figure 1:
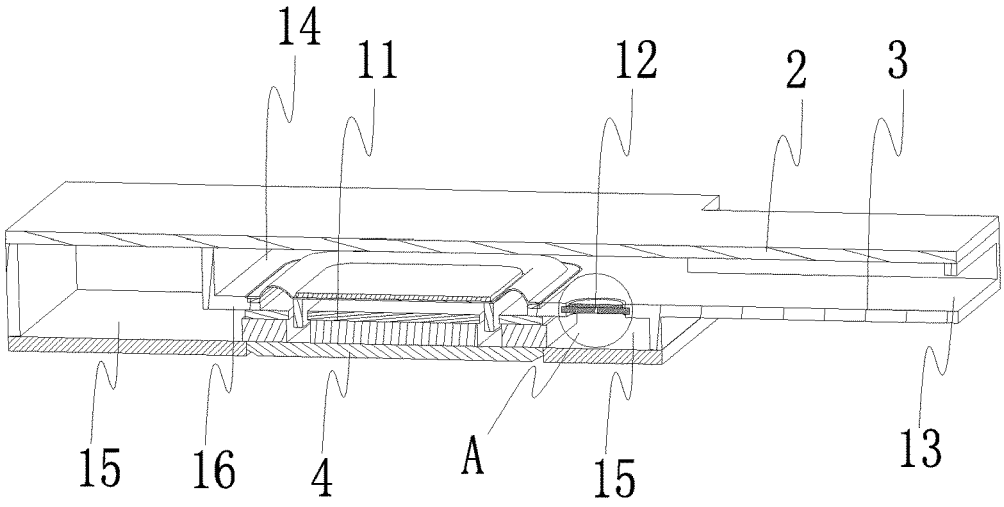
FIG. 1 is a section view of a speaker module in an embodiment of the invention.

Various exemplary embodiments of the present invention will now be described in detail with reference to the accompanying drawings. It should be noted that the relative arrangement, numerical expressions and numerical values of the components and steps set forth in these examples do not limit the scope of the invention unless otherwise specified.

The following description of at least one exemplary embodiment is in fact merely illustrative and is in no way intended as a limitation to the present invention and its application or use.

Techniques, methods, and apparatus known to those of ordinary skill in the relevant art may not be discussed in detail but where appropriate, the techniques, methods, and apparatus should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in the accompanying drawings, and therefore, once an item is defined in a drawing, and there is no need for further discussion in the subsequent accompanying drawings.

Figure 2:
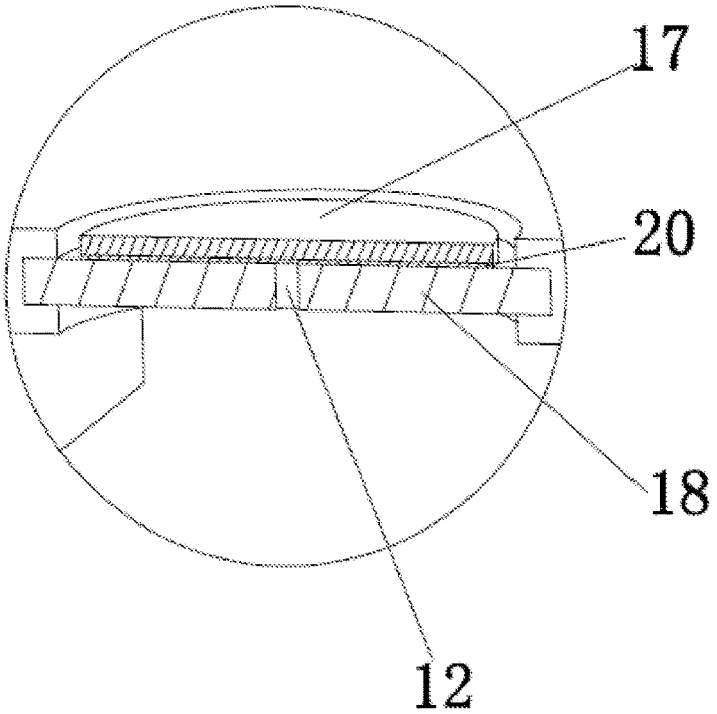
FIG. 2 is an enlarged partial view of Position A in FIG. 1.

The present invention provides a speaker module. Referring to FIGS. 1-2, the module comprises a housing and a speaker unit 11. The housing consists of an upper housing 2, a middle housing 3 and a lower housing 4 which are fastened together. The interior of the housing forms an inner chamber, and the speaker unit 11 is received in the inner chamber. The speaker unit 11 separates the inner chamber into a front sound chamber 14 and a rear sound chamber 15 that are isolated from each other. The space between a vibrating component of the speaker unit 11 and the upper housing 2 is a front sound chamber 14, the front sound chamber 14 communicating with the external environment. The space between the magnetic circuit component of the speaker unit 11 and the lower housing 4 is a rear sound chamber 15, the rear sound chamber 15 being a sealed space.

The speaker unit comprises a magnetic circuit system and a vibration system. The magnetic circuit system comprises a frame located within the inner chamber and a magnet located within the frame. A gap is formed between the magnet and the side wall of the frame. The magnet is provided with a washer. The vibration system comprises a vibrating diaphragm fixed within the inner chamber and a voice coil which drives the diaphragm to generate sounds. The voice coil is fixed on the vibrating diaphragm and suspended in the gap between the magnet and the side wall of the frame. A dome is provided in the center position of the vibrating diaphragm.

When the voice coil is energized, the voice coil will vibrate under the action of the magnetic circuit system, and at the same time, the voice coil will drive the vibrating diaphragm to vibrate together with the voice coil, in this way, the vibrating diaphragm generates sound. The housing is also provided with a sound hole 13 which communicates with the front sound chamber 14, permitting the sound generated from the vibrating diaphragm to spread from the sound hole 13 to the outside. The above structure falls within the common knowledge of those skilled in the art and will not be described in detail herein.

Referring to FIG. 2, in the present invention, a metal sheet is arranged on the housing at a position opposite to the rear sound chamber 15, and the metal sheet is provided with a pressure relief hole 12 which communicates the rear sound chamber 15 with the external environment and is acoustically sealed. The pressure relief hole 12 penetrates the metal sheet in the thickness direction. Air may pass through the pressure relief hole 12, thereby maintaining the air pressure balance between the rear sound chamber 15 and the external environment. The material of the metal sheet may be but is not limited to stainless steel, copper alloy or aluminum alloy. In view of the wide resources of raw materials, it is preferable that the stainless steel sheet 18 is used for the metal sheet.

It should be noted that the pressure relief hole 12 is acoustically sealed. For those skilled in the art, acoustic seal means an acoustically sealed status, that is, no sound waves are allowed to pass through. The pressure relief passage is acoustically sealed, that is, the sound in the front sound chamber 14 will not pass through the pressure relief passage to enter the rear sound chamber 15, thereby ensuring the sound isolation between the front sound chamber 14 and the rear sound chamber 15 and preventing a speaker failure.

In some embodiments, the acoustic seal of the pressure relief hole 12 can be achieved by means well known to those skilled in the art, such as by making the pressure relief hole very small in size, or by other widely known means to increase the damping of the pressure relief hole to turn the pressure relief hole into a damping orifice structure so that sound can be prevented from propagating within the pressure relief hole 12.

Referring to FIG. 2, in the present embodiment, the pressure relief hole 12 is positioned on the side away from the rear sound chamber 15; that is, a mesh is further disposed on the side close to the front sound chamber 14. In use, the mesh 17 is glued to and fixed on the stainless steel sheet 18 by spreading glue on the mesh 17 or using a double-sided adhesive 20 to ensure that the mesh 17 can cover the pressure relief hole 12. The mesh not only acts as a damper to achieve a better acoustical seal, but also is air-permeable to balance air pressure. Of course, for a person skilled in the art, adjusting the spacing between the mesh holes in the mesh 17 can achieve the purpose of adjusting the damping thereof. In the present invention, the mesh 17 can also prevent foreign matters from entering the rear sound chamber 15. More preferably, a waterproof mesh is used as it can improve the waterproof performance of a speaker module, which is better suited for waterproof portable devices.

Figure 3:
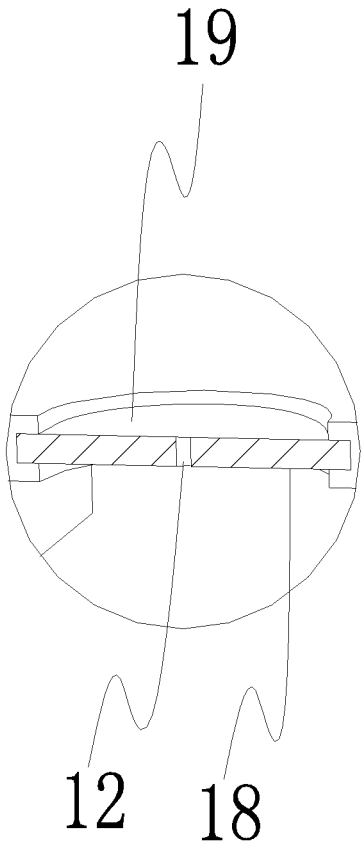
FIG. 3 is a schematic drawing of FIG. 2 without being provided with a mesh.

Further, in order to facilitate the installation of the mesh 17, referring to FIG. 3, the stainless steel sheet 18 is embedded in the housing on the side close to the front sound chamber 14 and forms a positioning groove 19. The mesh cloth 17 is disposed in the positioning groove 19, and the end face of the mesh 17 which is away from the stainless steel sheet 18 is flush with the surface of the housing. This structure saves space, keeps the rear sound chamber 15 smooth and tidy, and reduces the consumption amount of meshes.

The speaker module provided by the present invention has a housing embedded with a metal sheet, the metal sheet being provided with a pressure relief hole 12. The inner diameter of the pressure relief hole 12 can be made small according to actual needs. The rear sound chamber and the external environment can reach an air pressure balance and have good acoustic seal effect without additional arrangement of pressure relief groove. Furthermore, the pressure relief hole of the speaker module does not need a gland, and for the pressure relief hole, the structure is simple and the yield rate is high.

Referring to FIG. 1, in a preferred embodiment of the present invention, the stainless steel sheet 18 of the module is disposed on a separator 16, the separator separating the front sound chamber 14 from the rear sound chamber 15 within the housing. In some examples, the middle housing 3 is provided with a separator 16, the separator 16 being provided with a through hole used for mounting a speaker unit, and the separator 16 being also provided with a stainless steel sheet 18. It should be understood by those skilled in the art that the front sound chamber 14 communicates with the external environment through the sound hole 13, and therefore communication between the rear sound chamber 15 and the front sound chamber 14 is corresponding to communication between the rear sound chamber 15 and the external environment. It can be understood that pressure relief hole 12 is covered, on the side close to the front sound chamber 14, with a mesh cloth 17. In the speaker module, the pressure relief hole 12 is disposed in the interior of the housing, there is no need to separately dispose a pressure relief hole, which communicates with the external environment, in other positions of the rear sound chamber 15. Therefore, the entire speaker module is neat in appearance and the pressure relief hole 12 has no damage or clogging problems. Of course, it is also possible to provide the stainless steel sheet 18 on other positions of the housing, as long as the rear sound chamber communicates with the external environment.

In a specific embodiment of the present invention, in order to facilitate processing, the material of the upper housing, middle housing and lower housing is generally plastics, plastic cement or silica gel, which can be molded according to a predetermined structure by means of injection molding technology. The metal sheet is injection-molded into the middle housing by means of insert molding. A pressure relief hole should be disposed on the metal sheet prior to insert molding. The technical means commonly used in the art, such as a laser processing, can be adopted to form a pressure relief hole. Further, the shape of the cross-section of the pressure relief hole 12 may be, but is not limited to, a polygon such as a rectangle, a triangle, a circle, an ellipse or the like.

Further, it will be understood by those skilled in the art that the pressure relief hole 12 has an essential influence on the air pressure balance between the rear sound chamber 15 and external environment and the acoustic seal effect of the rear sound chamber 15. As the pressure relief hole 12 is longer and has a smaller inner diameter, it has higher acoustical resistance, a smaller sound leakage amount and a better acoustic sealing effect, but produces a worse air pressure equilibrium effect. Conversely, as the pressure relief hole 12 is shorter and has a larger inner diameter, it has lower sound resistance, a larger sound leakage amount, a worse acoustic sealing effect, but produces better air pressure balance. The thickness of the metal sheet cannot be made thicker because it is limited by the thickness of the middle housing 3; that is, the length of the pressure relief hole 12 cannot be made very long. However, since a metal sheet is used, the method to form a hole on a metal sheet is easier in a sheet of plastics, plastic cement, or silica gel, and a metal sheet has higher strength. Under the premise of ensuring the pressure equilibrium effect, the diameter of the pressure relief hole 12 can be made very small, and thus the acoustic sealing effect is improved. Preferably, the pressure relief hole 12 has a circular cross section with an inner diameter of 0.1 mm or less. Furthermore, a smaller inner diameter of the pressure relief hole 12 can also effectively improve the waterproof performance of the module.

In order to maintain the air pressure balance between the rear sound chamber 15 and the external environment, in a specific embodiment of the present invention, one or more pressure relief holes 12 are disposed on the stainless steel plate 18, and when a plurality of pressure relief holes are disposed, each pressure relief hole 12 communicates with the rear sound chamber 14 and the front sound chamber 15. The distribution pattern of the plurality of pressure relief holes 12 is not limited in the present invention. In another specific embodiment, a stainless steel plate 18 is embedded on the housing to balance the air pressure between the rear sound chamber 15 and the external environment.

While certain specific embodiments of the present invention have been illustrated by way of example, it will be understood by those skilled in the art that the foregoing examples are provided for the purpose of illustration and are not intended to limit the scope of the present invention. It will be understood by those skilled in the art that the foregoing embodiments may be modified without departing from the scope and spirit of the invention. The scope of the present invention is subject to the attached claims.

What is claimed is:

1. A speaker module, comprising a housing and a speaker unit located in an inner chamber of the housing, wherein the speaker unit separates the inner chamber into a front sound chamber and a rear sound chamber which are isolated from each other, the front sound chamber being in communication with the external environment, wherein the housing is embedded with a metal sheet, the metal sheet being disposed within the housing on a separator which is used for separating the front sound chamber from the rear sound chamber and being provided with a pressure relief hole which is acoustically sealed and used for communicating the rear sound chamber and the external environment, and wherein the pressure relief hole is provided with a mesh on the side away from the rear sound chamber.

2. The speaker module according to claim 1, wherein the metal sheet is embedded in the housing and forms a positioning groove on the side close to the front sound chamber, the mesh is arranged in the positioning groove, and the end face of the mesh which is away from the metal sheet is flush with the surface of the housing.

3. The speaker module according to claim 1, wherein the housing comprises an upper housing, a middle housing, and a lower housing which are fastened together, and the separator is disposed on the middle housing.

4. The speaker module according to claim 1, wherein the material of the metal sheet is stainless steel, copper alloy or aluminum alloy.

5. The speaker module according to claim 1, wherein the cross section of the pressure relief hole is polygonal or circular.

6. The speaker module according to claim 1, wherein the pressure relief hole is circular, and the inner diameter of the pressure relief hole is 0.1 mm or less.

7. The speaker module according to claim 1, wherein the metal sheet is provided as a single metal sheet.

8. The speaker module according to claim 1, wherein the pressure relief hole comprises a plurality of pressure relief holes.

9. The speaker module according to claim 1, wherein the mesh is a waterproof and air-permeable mesh.

* * * * *